US011218793B2

(12) United States Patent
Ko et al.

(10) Patent No.: US 11,218,793 B2
(45) Date of Patent: Jan. 4, 2022

(54) EARPHONE INCLUDING TUNING MEANS

(71) Applicant: ALMUS Corp., Chungcheongnam-do (KR)

(72) Inventors: Ju Heon Ko, Hwaseong-si (KR); Byung Il Min, Suwon-si (KR); Jeong Kwon Park, Yeoju-si (KR); Yeong Jae Lee, Yongin-si (KR)

(73) Assignee: ALMUS CORP., Chungcheongnam-Do (KR)

( * ) Notice: Subject to any disclaimer, the term of this patent is extended or adjusted under 35 U.S.C. 154(b) by 25 days.

(21) Appl. No.: 16/800,014

(22) Filed: Feb. 25, 2020

(65) Prior Publication Data

US 2021/0266654 A1 Aug. 26, 2021

(51) Int. Cl.

*H04R 1/10* (2006.01)
*H04R 9/02* (2006.01)
*H04R 1/28* (2006.01)

(52) U.S. Cl.

CPC ..... *H04R 1/1041* (2013.01); *H04R 1/1016* (2013.01); *H04R 1/1075* (2013.01); *H04R 1/2803* (2013.01); *H04R 1/288* (2013.01); *H04R 9/025* (2013.01)

(58) Field of Classification Search

CPC .. H04R 1/1041; H04R 1/1016; H04R 1/1075; H04R 1/2803; H04R 1/288; H04R 9/025; H04R 1/107

USPC ..... 381/380, 338, 337, 381

See application file for complete search history.

(56) References Cited

U.S. PATENT DOCUMENTS 10,477,307 B1 * 11/2019 Zhang ..... H04R 1/1016
2008/0170710 A1 * 7/2008 Pasternak ..... H04R 1/2849 381/74
2012/0020501 A1 * 1/2012 Lee ..... H04R 1/1091 381/151
2012/0076341 A1 * 3/2012 Ozawa ..... H04R 1/345 381/380
2013/0148834 A1 * 6/2013 Seo ..... H04R 1/2811 381/338
2013/0195293 A1 * 8/2013 Ko ..... H04R 1/24 381/191
2014/0226847 A1 * 8/2014 Yang ..... H04R 1/1058 381/380

(Continued)

FOREIGN PATENT DOCUMENTS

KR 20170098527 A 8/2017

*Primary Examiner* — Alexander Krzystan
*Assistant Examiner* — Julie X Dang
(74) *Attorney, Agent, or Firm* — Li & Cai Intellectual Property (USA) Office

(57) ABSTRACT

An earphone includes a housing, a speaker unit disposed in the housing, a cover coupled with the housing and including a nozzle, a first space portion disposed in front of the speaker unit, and a second space portion disposed in the rear of the speaker unit and partitioned off from the first space portion. Here, the speaker unit includes a cylindrical yoke with an open top, a magnet fixed to a bottom surface of an inside of the yoke, a plate fixed to a top surface of the magnet, a voice coil disposed between an inner circumference of the yoke and outer circumferences of the magnet and the plate, a vibration plate disposed above the plate and to which the voice coil is fixed, a cap coupled with the yoke, and a frame coupled with the yoke and the cap.

9 Claims, 14 Drawing Sheets

(56) References Cited

U.S. PATENT DOCUMENTS

2014/0348372 A1* 11/2014 Seo ..... H04R 1/1016
381/380

* cited by examiner

【FIG.1】
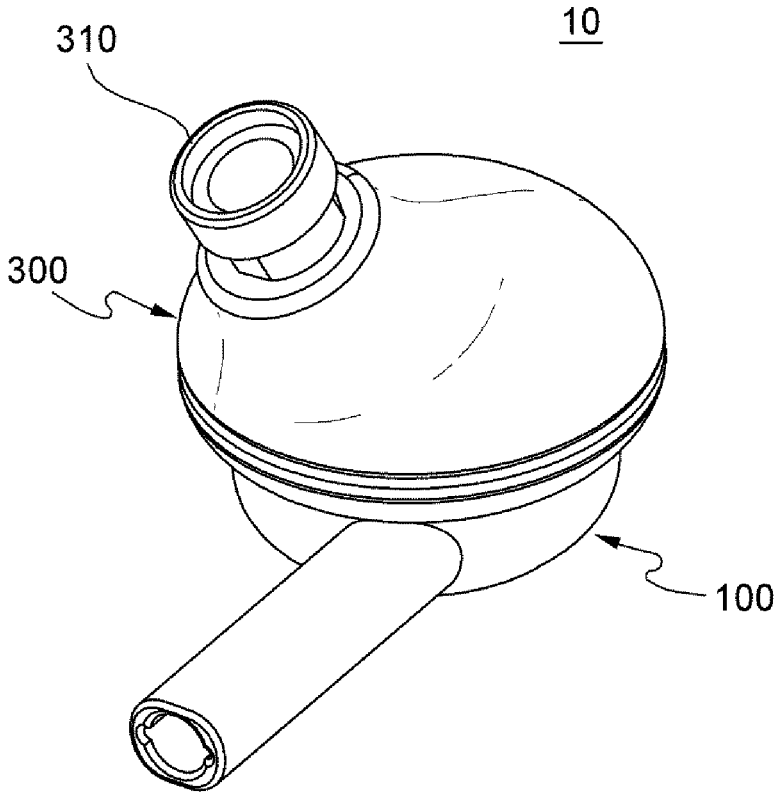

【FIG.2】
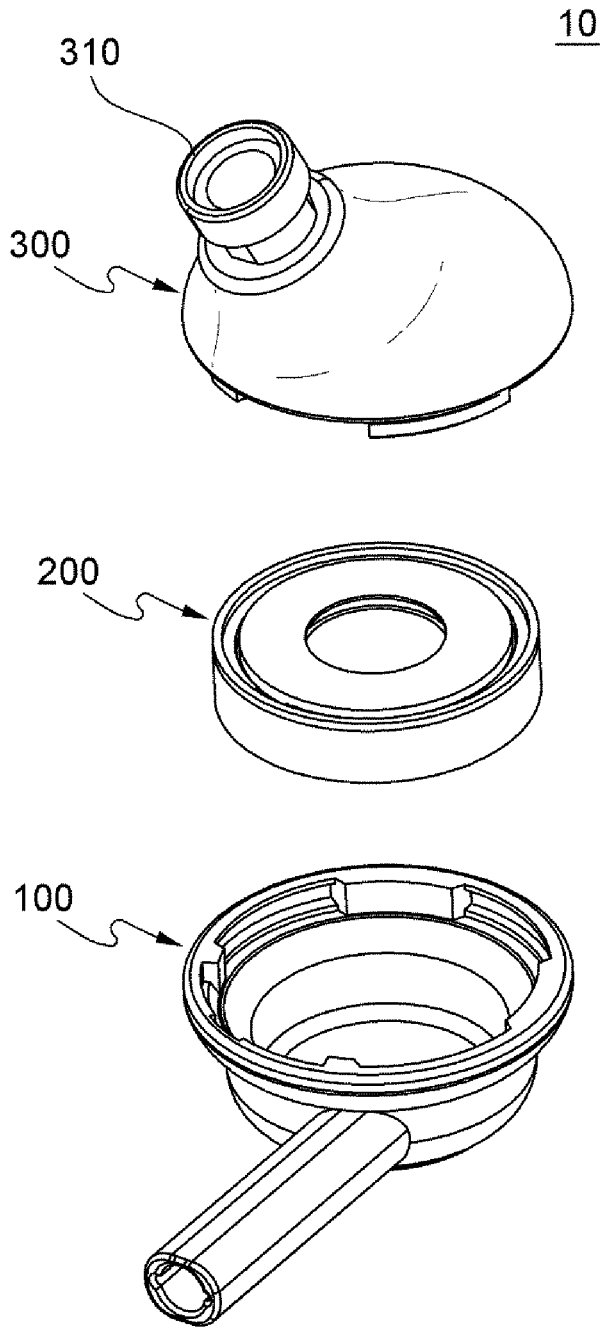

【FIG.3】
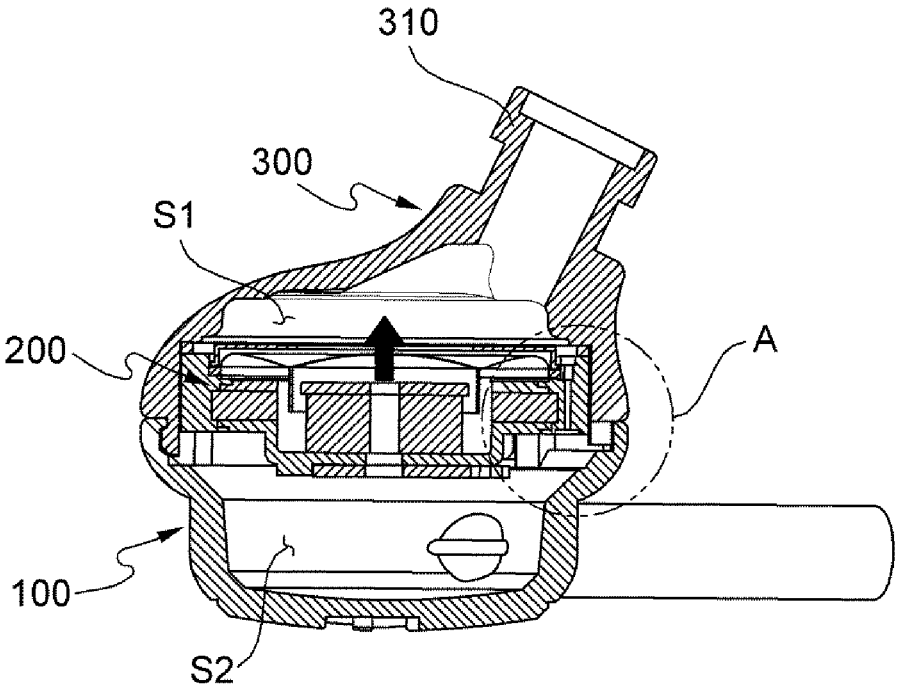

【FIG.4】
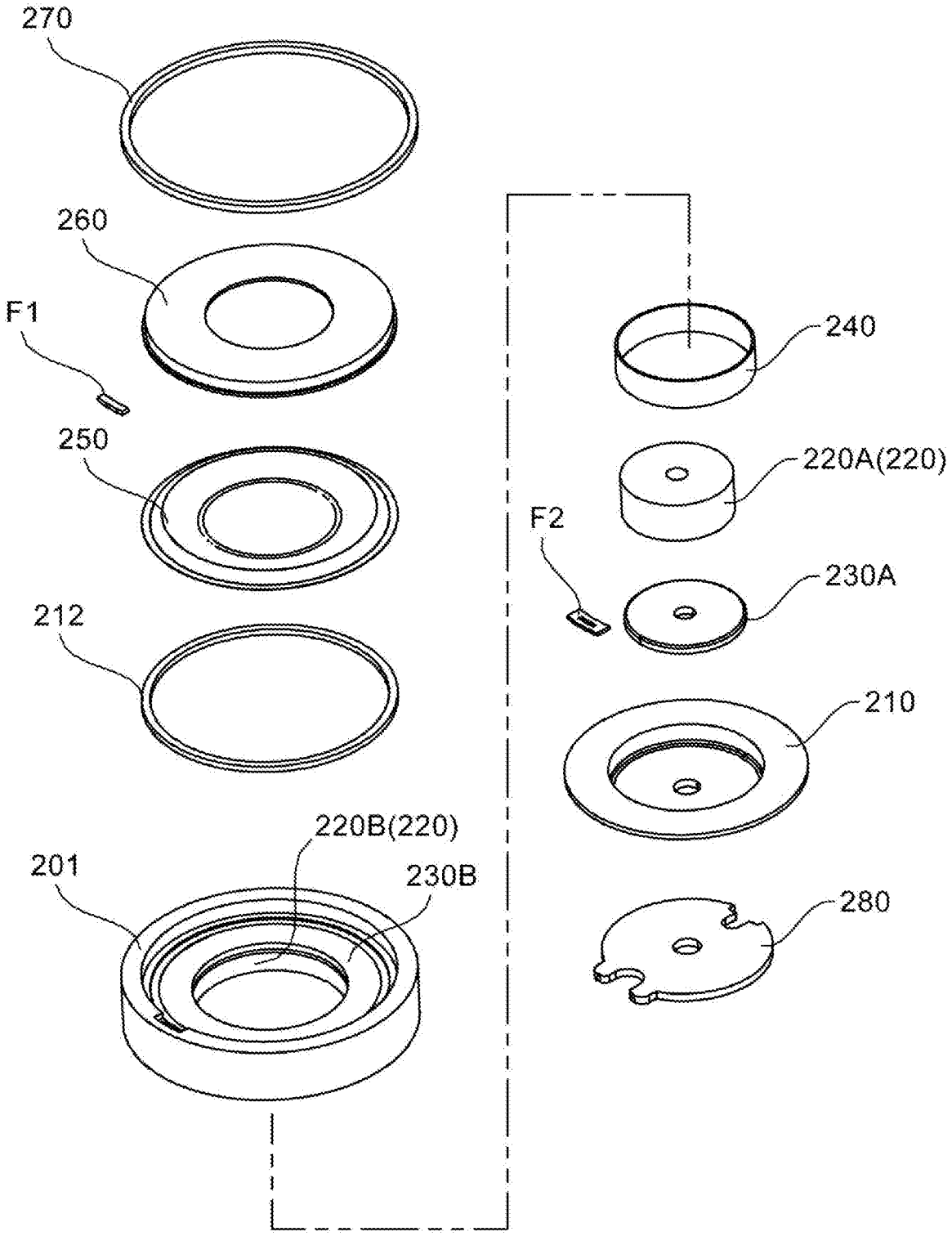

【FIG.5】
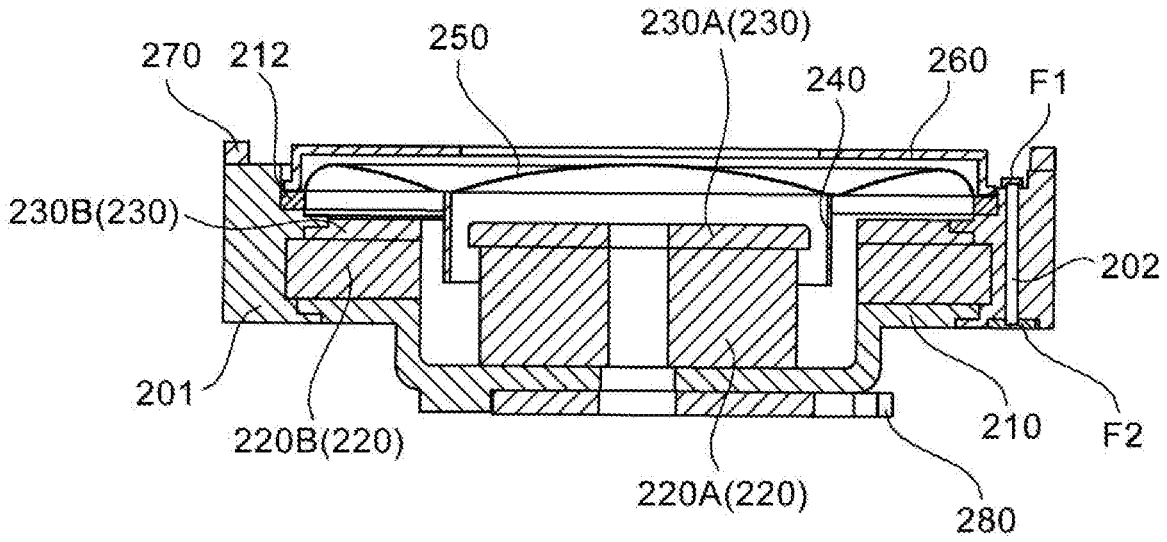
【FIG.6】
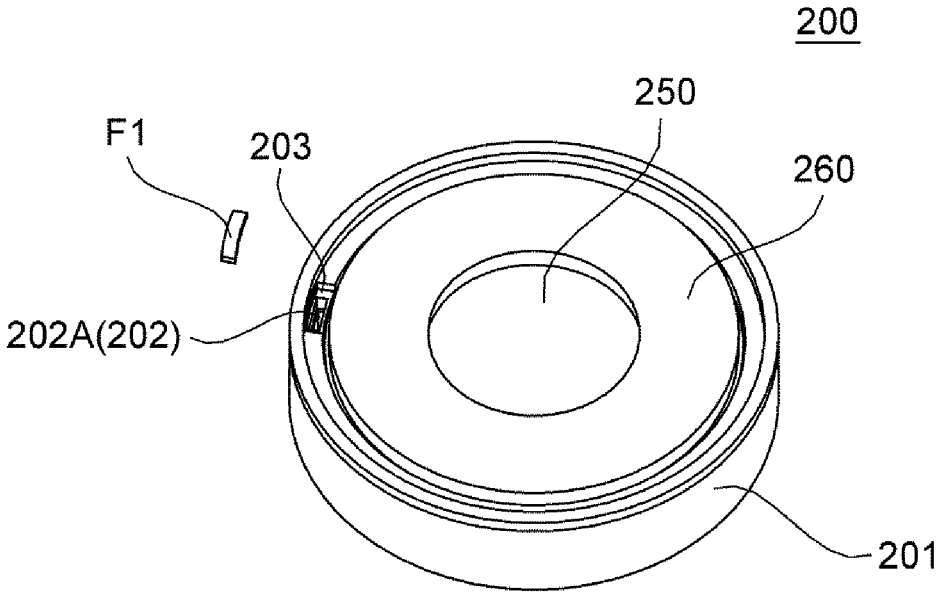

【FIG.7】
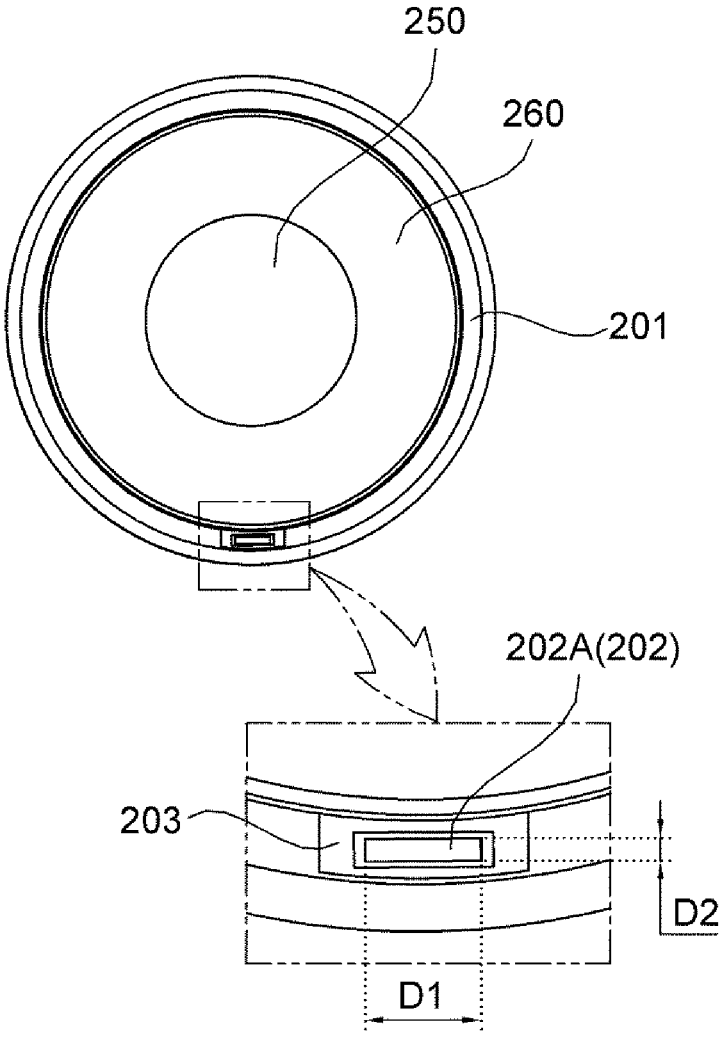

【FIG.8】
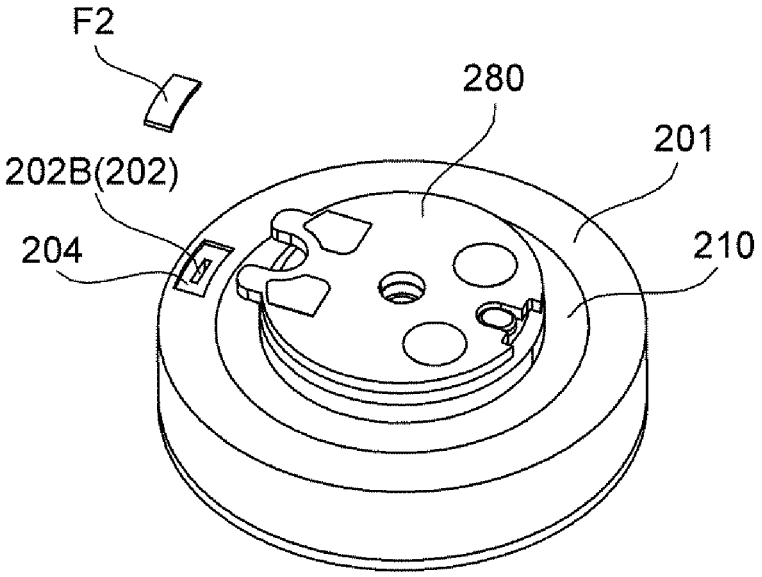

【FIG.9】
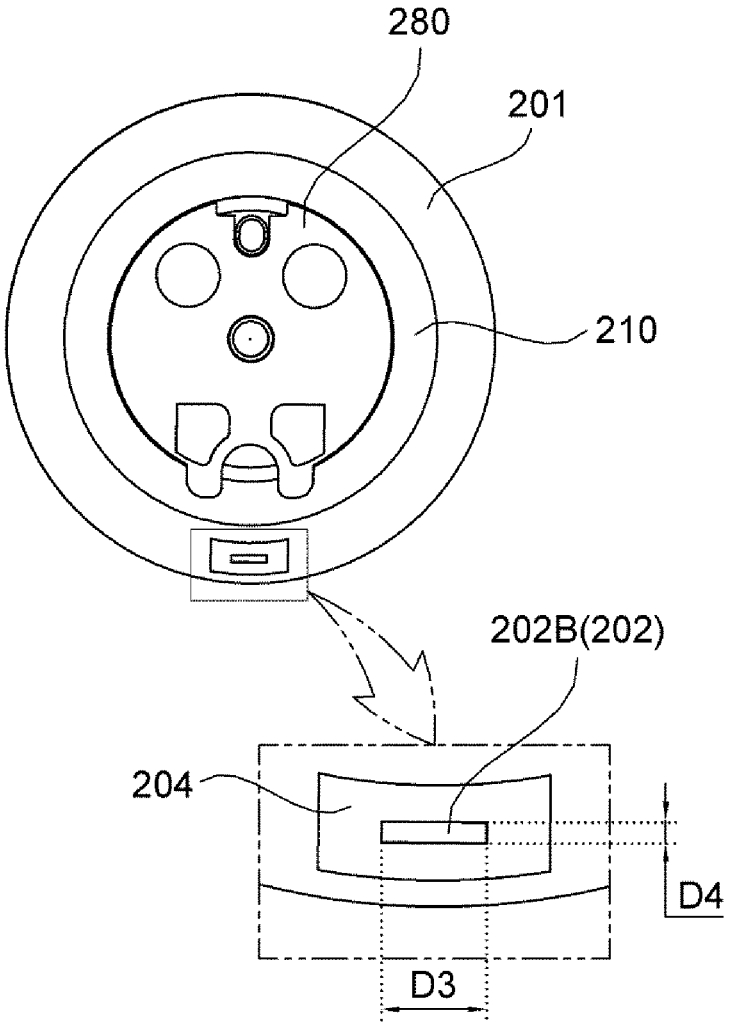

【FIG.10】
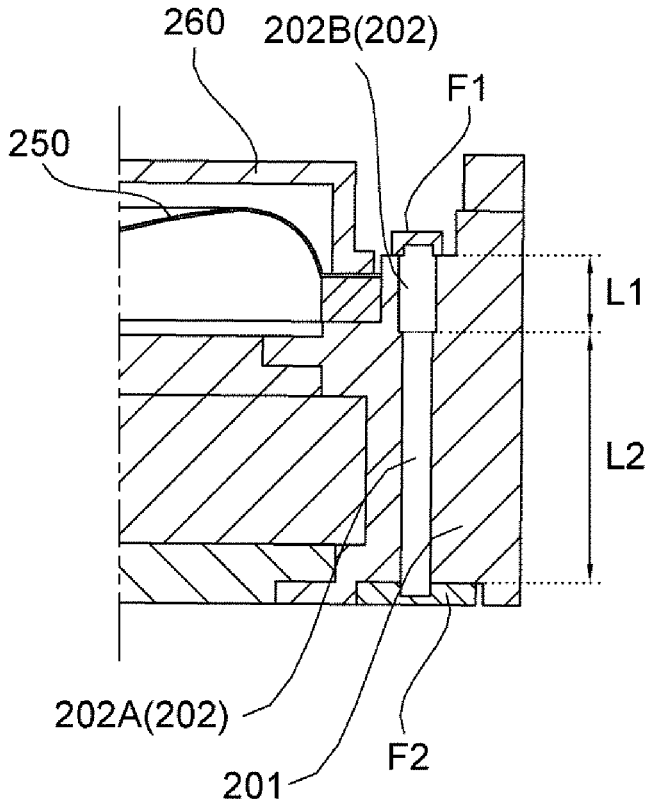

【FIG.11】
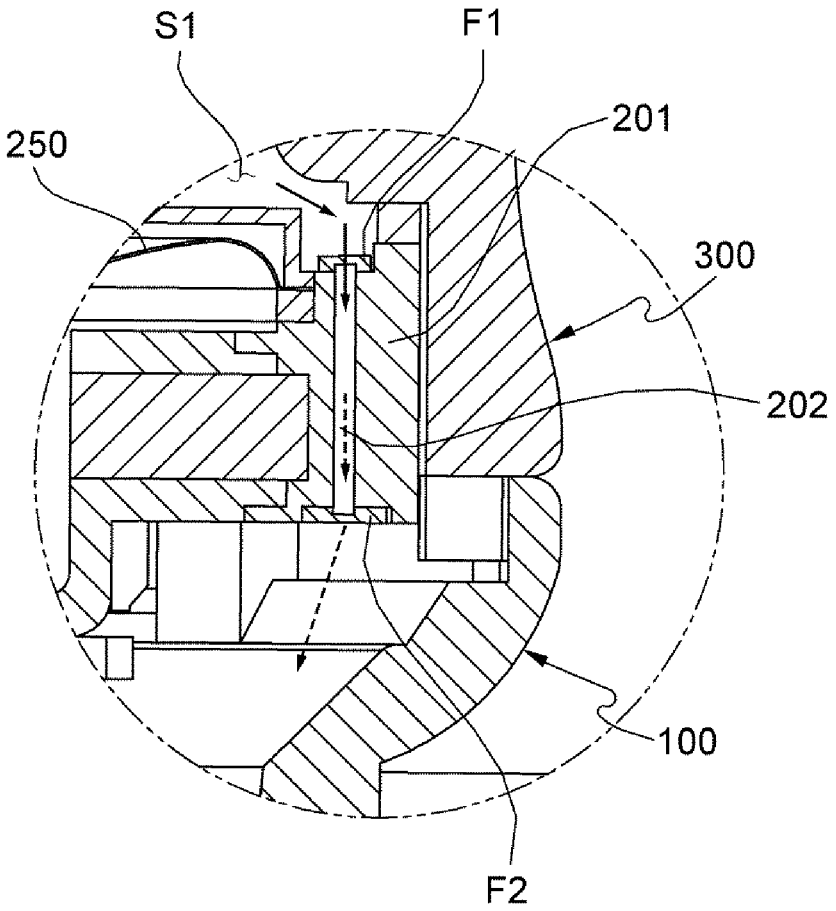

【FIG.12】
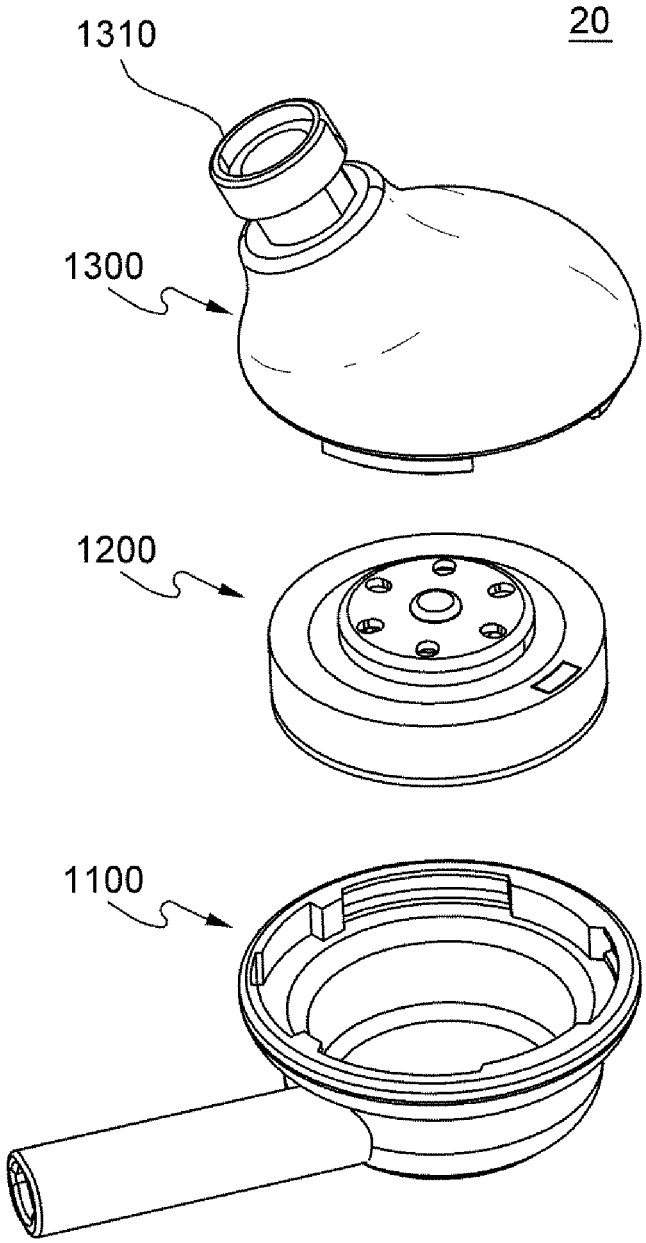

【FIG.13】
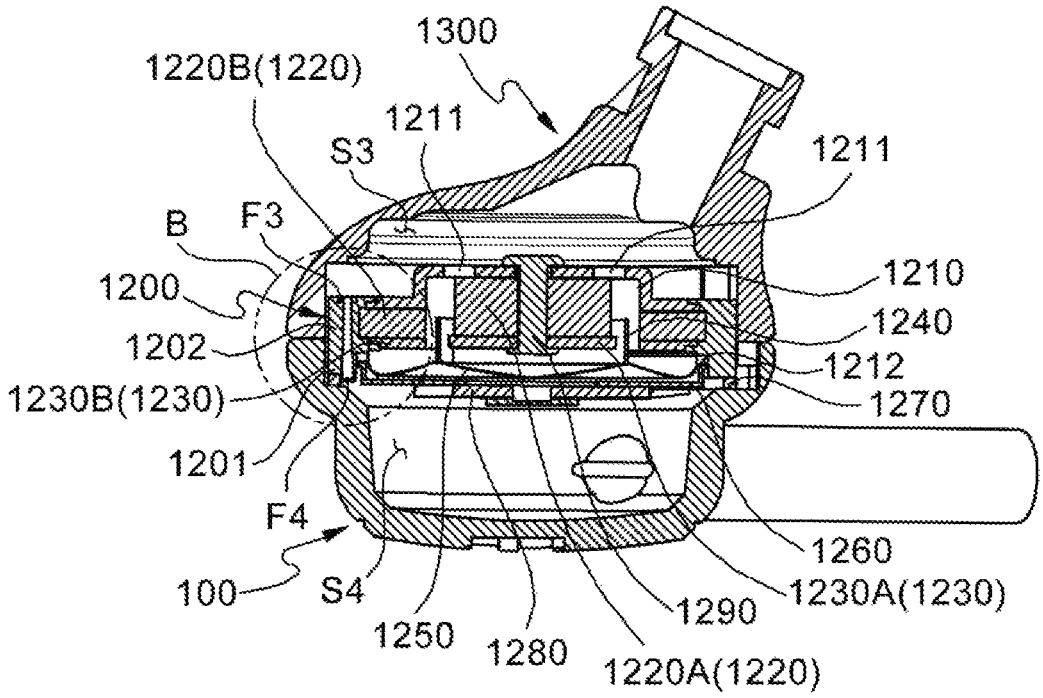

【FIG.14】
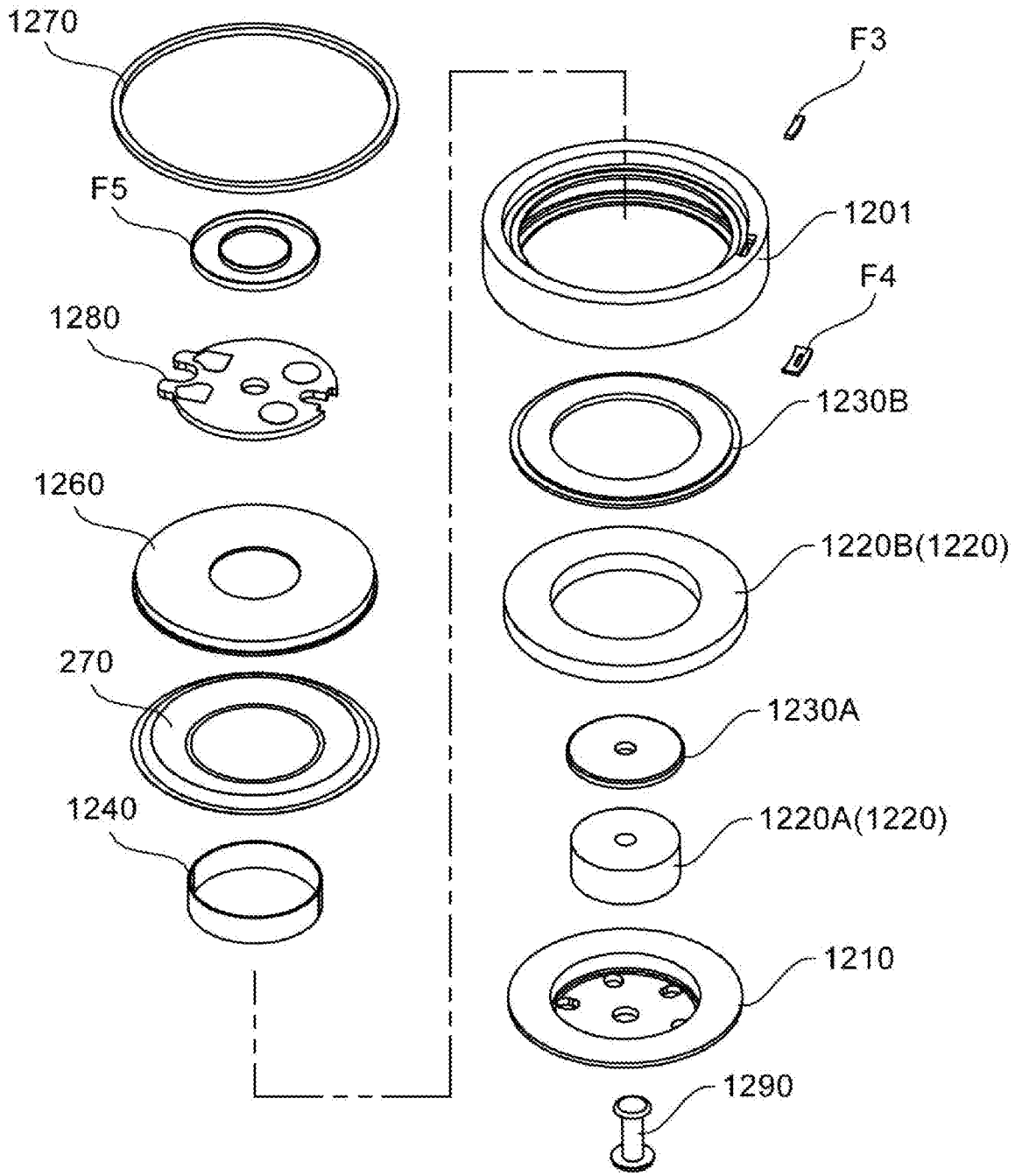

【FIG.15】
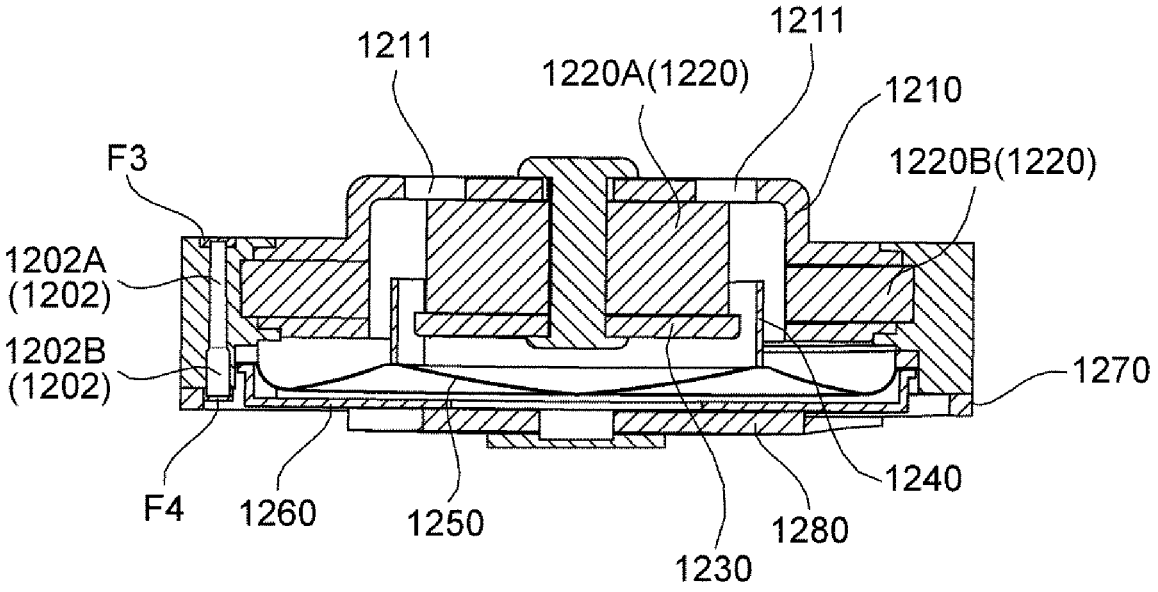
【FIG.16】
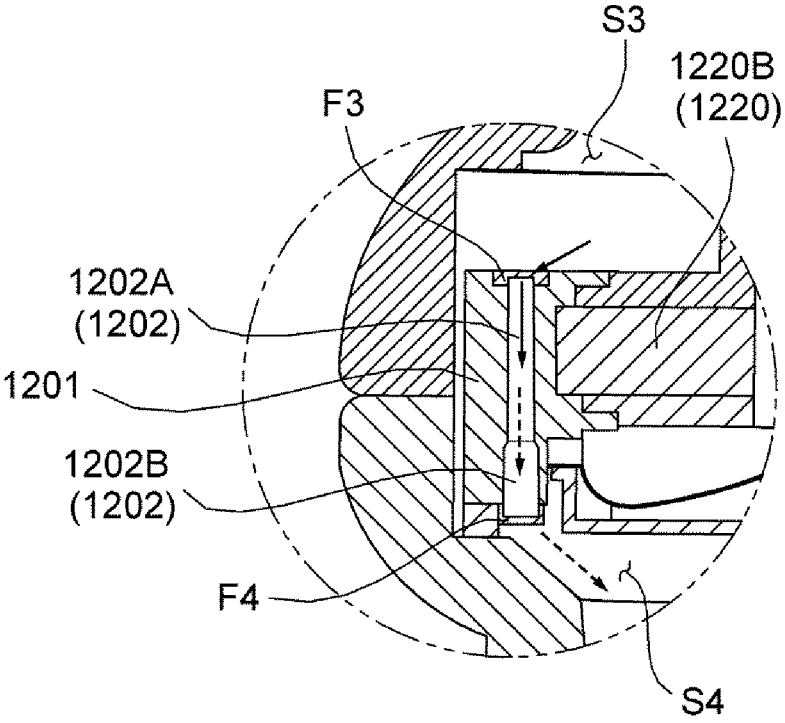

EARPHONE INCLUDING TUNING MEANS

BACKGROUND

1. Field of the Invention

The present invention relates to an earphone including a tuning means.

2. Discussion of Related Art

An earphone includes a speaker unit which generates a sound wave in a housing. Also, the earphone includes a cover including a nozzle with which an ear tip is coupled. The cover is coupled with the housing. Korean Patent Publication No. 10-2017-0098527 (published on Aug. 30, 2017, hereinafter, referred to as the document) discloses an earphone including a nozzle. In the document, a front housing including the nozzle is coupled with a rear housing including a speaker unit.

Meanwhile, in the document, a tuning groove configured to change a tone may be provided in a cover portion corresponding to the front housing including the nozzle. Some of sound waves generated by the speaker unit are discharged into the tuning groove such that a tone or sound feature of a sound output through the nozzle may be changed. The tuning hole is disposed in a front surface of the cover portion and exposed to the outside. Accordingly, there is a problem that water or foreign substances flow into the housing of the earphone through the tuning groove. Also, there is a problem that external noise causes a loss of sounds of the earphone.

RELATED ART DOCUMENT

Patent Document

Korean Patent Publication No. 10-2017-0098527 (published on Aug. 30, 2017)

SUMMARY OF THE INVENTION

The present invention is directed to providing an earphone in which a tuning means capable of changing a tone and preventing water or foreign substances from flowing into a housing of the earphone is provided.

The present invention is also providing an earphone capable of fundamentally excluding sound interference from external noise.

Aspects of the present invention are not limited to the above-stated aspects and other unstated aspects of the present invention will be understood by those skilled in the art from a following disclosure.

According to an aspect of the present invention, there is provided an earphone, in which a tuning means is provided. The earphone includes a housing, a speaker unit disposed in the housing, a cover coupled with the housing and including a nozzle, a first space portion disposed in front of the speaker unit, and a second space portion disposed in the rear of the speaker unit and partitioned off from the first space portion. Here, the speaker unit includes a cylindrical yoke with an open top, a magnet fixed to a bottom surface of an inside of the yoke, a plate fixed to a top surface of the magnet, a voice coil disposed between an inner circumference of the yoke and outer circumferences of the magnet and the plate, a vibration plate disposed above the plate and to which the voice coil is fixed, a cap coupled with the yoke, and a frame coupled with the yoke and the cap. Also, the frame includes a tuning hole which is disposed to pass through from a top surface to a bottom surface of the frame and allows the first space portion and the second space portion to communicate with each other and a tuning portion which covers the tuning hole.

The tuning portion may include a first tuning portion and a second tuning portion. Here, the frame may include a first accommodation groove formed to be concave in a top surface. Also, the first tuning portion may be disposed in the first accommodation groove and cover the tuning hole.

The frame may include a second accommodation groove formed to be concave in a bottom surface thereof, and the second tuning portion may be disposed in the second accommodation groove and cover the tuning hole.

The tuning hole may include a first hole and a second hole. Here, the first hole may be connected to the first space portion, and the second hole may communicate with the second space portion.

A sectional size of the first hole may differ from a sectional size of the second hole.

A length of the first hole may differ from a length of the second hole.

The tuning portion may include a first tuning portion and a second tuning portion. Here, when a side facing the cover is referred to as a front and a side facing the housing is referred to as a rear on the basis of the speaker unit, the vibration plate may be disposed in front of the magnet, an inlet of the tuning hole may be connected to the first space portion, and an outlet of the tuning hole may be connected to the second space portion. Also, the first tuning portion may be disposed at the inlet, and the second tuning portion may be disposed at the outlet.

The speaker unit may further include a damper, and the damper may be disposed on a top surface of the frame and come into contact with an inner surface of the cover.

The tuning portion may include a first tuning portion and a second tuning portion. Here, when a side facing the cover is referred to as a front and a side facing the housing is referred to as a rear on the basis of the speaker unit, the vibration plate may be disposed in the rear of the magnet, an inlet of the tuning hole may be connected to the first space portion, and an outlet of the tuning hole may be connected to the second space portion. Also, the first tuning portion may be disposed at the inlet, and the second tuning portion may be disposed at the outlet.

The speaker unit may further include a damper, and the damper may be disposed on a bottom surface of the frame and come into contact with an inner surface of the housing.

BRIEF DESCRIPTION OF THE DRAWINGS

The above and other objects, features and advantages of the present invention will become more apparent to those of ordinary skill in the art by describing exemplary embodiments thereof in detail with reference to the accompanying drawings, in which:

FIG. 1 is a perspective view of an earphone including a tuning means according to a first embodiment;

FIG. 2 is an exploded view of the earphone shown in FIG. 1;

FIG. 3 is a side cross-sectional view of the earphone shown in FIG. 1;

FIG. 4 is an exploded view illustrating a speaker unit shown in FIG. 2;

FIG. 5 is a side view of the speaker unit shown in FIG. 2;

FIG. 6 is a view illustrating a first tuning portion and the speaker unit including a first tuning hole;

FIG. 7 is a view illustrating the first tuning hole;

FIG. 8 is a view illustrating a second tuning portion and the speaker unit including a second tuning hole;

FIG. 9 is a view illustrating the second tuning hole;

FIG. 10 is a side cross-sectional view of the speaker unit;

FIG. 11 is an enlarged view illustrating part A of FIG. 3 and illustrates a sound wave transmitted from a first space portion to a second space portion;

FIG. 12 is an exploded view of an earphone according to a second embodiment;

FIG. 13 is a side cross-sectional view of the earphone shown in FIG. 12;

FIG. 14 is an exploded view illustrating a speaker unit shown in FIG. 12;

FIG. 15 is a side cross-sectional view of the speaker unit; and

FIG. 16 is an enlarged view illustrating part B of FIG. 13 and is a side cross-sectional view of the earphone.

DETAILED DESCRIPTION OF EXEMPLARY EMBODIMENTS

The aspects, particular advantages, and novel features of the present invention will become apparent from a detailed description of exemplary embodiments with reference to the attached drawings. Also, the terms used in the specification and the claims should not be limited to general or lexical meanings and should be interpreted as meanings and concepts coinciding with the technical concept of the present invention on the basis of a principle in which the inventor can appropriately define the concept of the terms to describe the invention in the best manner. Also, in describing the present invention, a detailed description of well-known functions or components of the related art will be omitted when it is deemed to obscure the essence of the present invention.

Hereinafter, an earphone according to an embodiment will be described in detail with reference to the attached drawings.

FIG. 1 is a perspective view of an earphone including a tuning means according to a first embodiment, FIG. 2 is an exploded view of the earphone shown in FIG. 1, and FIG. 3 is a side cross-sectional view of the earphone shown in FIG. 1.

Referring to FIGS. 1 to 3, the earphone according to the embodiment includes a housing 100, a speaker unit 200, and a cover 300. Hereinafter, the terms such as front side and front surface include a meaning of indicating a direction of facing the cover 300 on the basis of the speaker unit 200, and the term such as rear side indicates a direction of facing the housing 100 on the basis of the speaker unit 200.

The housing 100 accommodates the speaker unit 200 therein. A cable is led into the housing 100. The led cable is connected to the speaker unit 200. Overall, the housing 100 may be a cylindrical member with an open front. The cover 300 may be coupled with a front of the housing 100.

The speaker unit 200 converts an electrical signal into a sound wave which is an audio signal.

The cover 300 is coupled with the housing 100. The cover 300 covers the housing 100 which is opened. The cover 300 includes a nozzle 310. The nozzle 310 is a place where an ear tip is coupled to.

While the speaker unit 200 is accommodated in the housing 100 and the cover 300, an inner space of the housing 100 and the cover 300 is divided into a first space portion S1 and a second space portion S2 by the speaker unit 200.

Referring to FIG. 3, the first space portion S1 means a space disposed in front of the speaker unit 200. In detail, the first space portion S1 means a space surrounded by inner surfaces of the speaker unit 200 and the cover 300 while the speaker unit 200 is accommodated in the housing 100 and the cover 300. The first space portion S1 communicates with the nozzle 310.

The second space portion S2 means a space disposed in the rear of the speaker unit 200. In detail, the second space portion S2 means a space surrounded by inner surfaces of the speaker unit 200 and the housing 100 while the speaker unit 200 is accommodated in the housing 100 and the cover 300.

FIG. 4 is an exploded view illustrating the speaker unit shown in FIG. 2, and FIG. 5 is a side view illustrating the speaker unit shown in FIG. 2.

Referring to FIGS. 3 to 5, the speaker unit 200 includes a yoke 210.

The yoke 210 is a cylindrical member with an open top. The yoke 210 performs a function of forming a magnetic circuit and accommodates magnets 220A and 220B.

The speaker unit 200 may include two magnets 220A and 220B. A first magnet 220A may be accommodated inside the yoke 210, and a second magnet 220B may be accommodated outside the yoke 210. The first magnet 220A may have a cylindrical shape, and the second magnet 220B may have an annular shape. The second magnet 220B may be disposed outside the first magnet 220A. However, the magnet may include only any one of the first magnet 220A and the second magnet 220B.

The speaker unit 200 includes two plates 230A and 230B. The first plate 230A is disposed on a top surface of the first magnet 220A. The second plate 230B is disposed on a top surface of the second magnet 220B.

The speaker unit 200 includes a voice coil 240. The voice coil 240 is fixed to a vibration plate 250, and a lower part thereof is disposed between an inner circumference of the yoke 210 and outer circumferences of the first magnet 220A and the first plate 230A.

The speaker unit 200 includes the vibration plate 250. The vibration plate 250 has an outer circumferential part fixed to an inner parameter of the yoke 210 and is disposed above a plate 230.

The speaker unit 200 includes a cap 260. The cap 260 covers the yoke 210. An inner circumference of the cap 260 may be formed to be greater than an outer circumference of the yoke 210.

The speaker unit 200 includes a damper 270. The damper 270 is disposed on a top surface of a frame 201. The damper 270 is disposed along an edge of the frame 201 and comes into contact with an inner wall of the cover 300.

The speaker unit 200 includes a substrate 280. The substrate 280 is coupled with a bottom surface of the yoke 210, receives an electrical signal from the outside, and transmits the electrical signal to the voice coil 240.

The speaker unit 200 includes the frame 201. The frame 201 is coupled with the yoke 210 and the cap 260. The frame 201 may be a ring-shaped member including an inner circumferential surface and an outer circumferential surface. The frame 201 includes a tuning hole 202 and a tuning groove 203. A ring 212 may be disposed between the frame 201 and the cap 260.

A magnetic field moves to a space between the plates 230A and 230B and the yoke 210. When a current is applied to the voice coil 240 such that the voice coil 240 is magnetized, the voice coil 240 moves according to a magnetic polarity of the voice coil 240. That is, when the polarity of the voice coil 240 is equal to polarities of the plates 230A and 230B and the yoke 210, the voice coil 240 is pushed and moved away. When the polarity of the voice coil 240 differs from polarities of the plates 230A and 230B and the yoke 210, the voice coil 240 is pulled and moved. As described above, when the voice coil 240 moves, the vibration plate 250 generates a sound by vibrating air while moving back and forth.

The earphone 10 according to the first embodiment includes the speaker unit 200 which is normally aligned. The normal alignment means an aligned position of the speaker unit 200 in which the vibration plate 250 is disposed in front of the magnet 220 such that a sound generated by the vibration plate 250 is transmitted to the first space portion S1 via the cap 260.

FIG. 6 is a view illustrating a first tuning portion and the speaker unit including a first tuning hole, and FIG. 7 is a view illustrating the first tuning hole.

Referring to FIGS. 6 and 7, the frame 201 includes a first accommodation groove 203 formed to be concave in a top surface thereof. The first accommodation groove 203 is formed to be concave in the top surface of the frame 201. A plurality of such first accommodation grooves 203 may be present. A first tuning hole 202A is disposed in the first accommodation groove 203.

A plurality of such first tuning holes 202A may be present. A first tuning portion F1 is mounted in the first accommodation groove 203. The first tuning portion F1 covers the first tuning hole 202A. A shape of the first tuning hole 202A may have an oblong shape as shown in the drawing but is not limited thereto and may have a circular shape, an elliptical shape, and the like.

A sound, which has passed through the first tuning portion F1, changes in a tone or sound feature. The first tuning portion F1 may be a mesh material and may include polyester, nylon, nonwoven fabric, a membrane filter, and the like.

The tone or sound feature may be minutely adjusted by changing a size, a shape, a material, density, or the like of the first tuning hole 202A. For example, the tone or sound feature may be minutely adjusted by changing a width D1 and a length D2 of the first tuning hole 202A. When a plurality of such speaker units are provided for each size or shape of the first tuning hole 202A, there is present an advantage of adjusting a tone feature by only replacing the speaker unit.

FIG. 8 is a view illustrating a second tuning portion and the speaker unit including a second tuning hole, and FIG. 9 is a view illustrating the second tuning hole.

Referring to FIGS. 8 and 9, the frame 201 includes a second accommodation groove 204 formed to be concave in a bottom surface thereof. The second accommodation groove 204 is formed to be concave in the bottom surface of the frame 201. A plurality of such second accommodation grooves 204 may be present. A second tuning hole 202B is disposed in the second accommodation groove 204.

A plurality of such second tuning holes 202B may be present. A second tuning portion F2 is mounted in the second accommodation groove 204. The second tuning portion F2 covers the second tuning hole 202B. A shape of the second tuning hole 202B may have an oblong shape as shown in the drawing but is not limited thereto and may have a circular shape, an elliptical shape, and the like.

A sound, which has passed through the second tuning portion F2, changes in a tone or sound feature. The second tuning portion F2 may be a mesh material and may include polyester, nylon, nonwoven fabric, a membrane filter, and the like.

The tone or sound feature may be minutely adjusted by changing a size, a shape, a material, density, or the like of the second tuning hole 202B. For example, the tone or sound feature may be minutely adjusted by changing a width D3 and a length D4 of the second tuning hole 202B. When a plurality of such speaker units are provided for each size or shape of the second tuning hole 202B, there is present an advantage of adjusting a tone feature by only replacing the speaker unit.

FIG. 10 is a side cross-sectional view of the speaker unit.

Referring to FIG. 10, the first tuning portion F1 is disposed above the tuning hole 202. Also, the second tuning portion F2 is disposed below the tuning hole 202. The tuning hole 202 may include a first hole 202A and a second hole 202B. A sectional size of the first hole 202A may be greater than a sectional size of the second hole 202B. Also, a length L2 of the second hole 202B may be greater than a length L1 of the first hole 202A.

FIG. 11 is an enlarged view illustrating part A of FIG. 3 and illustrates a sound wave transmitted from the first space portion to the second space portion.

Referring to FIG. 11, a sound generated by moving the vibration plate 250 is transferred to the first space portion S1. A part of the sound transferred to the first space portion S1 passes through the first tuning portion F1. During this process, the sound is primarily tuned. The sound, which has passed through the first tuning portion F1, passes through the second tuning portion F2 through the tuning hole 202. Here, the sound is secondarily tuned.

There is no hole, which communicates with the outside, in the cover 300 and the housing 100. Accordingly, the space formed by the housing 100 and the cover 300 is in a sealed state such that external noise may be blocked and a loss of the sound may be minimized. Also, since a hole is not present in a surface of the earphone, there is provided an advantage of being strong on an external shock. Also, due to high hermeticity, it is possible to prevent foreign substances or water from flowing into the earphone.

Although the space formed by the housing 100 and the cover 300 is in the sealed state, air in the first space portion S1 is transferred and communicated to the second space portion S2 through the tuning hole 202. Accordingly, a phenomenon in which fatigue of a tympanum of a listener which may occur due to the sealed space becomes serious or the listener is deafened is prevented.

FIG. 12 is an exploded view of an earphone according to a second embodiment, and FIG. 13 is a side cross-sectional view of the earphone shown in FIG. 12.

Referring to FIGS. 12 and 13, an earphone 20 according to the second embodiment includes a speaker unit 1200, which is reversely aligned, unlike the earphone 10 according to the first embodiment. The reverse alignment means an aligned position of the speaker unit 1200 in which a vibration plate 1250 is disposed in the rear of magnets 1220A and 1220B such that a sound generated by the vibration plate 1250 is transferred to a first space portion S3 via a hole 1211 of a yoke 1210. The earphone 20 according to the second embodiment has a feature that a substrate 1280 is coupled with a bottom surface of a cap 1260.

FIG. 14 is an exploded view of the speaker unit shown in FIG. 12, and FIG. 15 is a side cross-sectional view of the speaker unit.

Referring to FIGS. 14 and 15, the speaker unit 1200 includes the yoke 1210, a magnets 1220, a plate 1230, a voice coil 1240, the vibration plate 1250, the cap 1260, a damper 1270, the substrate 1280, and a rivet 1290.

The yoke 1210 is a cylindrical member with an open bottom. The yoke 1210 performs a function of forming a magnetic circuit and accommodates the magnets 1220A and 1220B.

The speaker unit 1200 may include two magnets 1220A and 1220B. A first magnet 1220A may be accommodated inside the yoke 1210, and a second magnet 1220B may be accommodated outside the yoke 1210. The first magnet 1220 may have a cylindrical shape. The second magnet 1220B may have an annular shape. The second magnet 1220B may be disposed outside the first magnet 1220A. However, the magnet may include only any one of the first magnet 1220A and the second magnet 1220B.

The speaker unit 1200 includes two plates 1230A and 1230B. The first plate 1230A is disposed on a bottom surface of the first magnet 1220A. The second plate 1230B is disposed on a bottom surface of the second magnet 1220B.

The speaker unit 1200 includes a voice coil 1240. The voice coil 1240 is fixed to the vibration plate 1250, and an upper part thereof is disposed between the second magnet 1220B and outer circumferences of the first magnet 1220A and the first plate 1230A.

The speaker unit 1200 includes the vibration plate 1250. An outer circumferential part of the vibration plate 1250 may be fixed to an inner parameter of the yoke 1210.

The speaker unit 1200 includes the cap 1260. The cap 1260 covers the yoke 1210. An inner circumference of the cap 1260 may be formed to be greater than an outer circumference of the yoke 1210.

The damper 1270 is disposed on a bottom surface of a frame 1201. The damper 1270 is disposed along an edge of the frame 1201 and comes into contact with an inner wall of a cover 1100.

The substrate 1280 is coupled with a bottom surface of the yoke 1210, receives an electrical signal from the outside, and transmits the electrical signal to the voice coil 1240. A third tuning portion F5 may be disposed on a bottom surface of the substrate 1280.

The rivet 1290 passes through and coaxially fastens the yoke 1210, the first magnet 1220A, and the first plate 1230A to one another. A through hole is disposed in a center of each of the yoke 1210, the first magnet 1220A, and the first plate 1230A, and the rivet 1290 passes through the through hole.

The frame 1201 is coupled with the yoke 1210 and the cap 1260. The frame 1201 may be a ring-shaped member including an inner circumferential surface and an outer circumferential surface. The frame 1201 includes a tuning hole 1202. The tuning hole 1202 may include a first hole 1202A and a second hole 1202B. A ring 1212 may be disposed between the frame 1201 and the cap 1260.

FIG. 16 is an enlarged view illustrating part B of FIG. 13 and is a side cross-sectional view of the earphone.

Referring to FIGS. 13 and 16, a sound generated by moving of the vibration plate 1250 passes through a first tuning portion F3 and is transmitted to the first hole 1202A. The sound, which has passed through the first tuning portion F3, is primarily tuned. The sound transmitted to the first hole 1202A is transmitted to a second tuning portion F4 through the second hole 1202B. The sound is secondarily tuned by the second tuning portion F4.

As described above, the earphone which includes a tuning means according to one exemplary embodiment of the present invention has been described in detail.

According to the embodiment, there is provided an advantageous effect of fundamentally eliminating a tuning hole, which is externally exposed, by forming a tuning hole in a frame of a speaker unit.

According to the embodiment, there is provided an advantageous effect of preventing water or foreign substances from flowing into a housing of an earphone.

According to the embodiment, there is provided an advantageous effect of minutely adjusting a sound by replacing speaker units having different-sized tuning holes.

According to the embodiment, since there is no hole in a surface of the earphone, there is provided an advantage of being strong on an external shock.

According to the embodiment, there is provided an advantageous effect of preventing a phenomenon in which fatigue of a tympanum of a listener becomes serious or the listener is deafened.

It should be noted that the above-described one embodiment of the present invention is merely an example in all aspects and is not intended to be limitative, and the scope of the present invention will be defined by the following claims rather than the above detailed description. Also, it should be construed that all changeable or modifiable shapes derived from the meaning and scope of the claims and equivalents thereof are included in the scope of the present invention.

What is claimed is:

1. An earphone, in which a tuning means is provided, the earphone comprising:

a housing;

a speaker unit disposed in the housing;

a cover coupled with the housing and including a nozzle;

a first space portion disposed in front of the speaker unit; and a second space portion disposed in the rear of the speaker unit and partitioned off from the first space portion, wherein the speaker unit comprises:

a cylindrical yoke with an open top;

a magnet fixed to a bottom surface of an inside of the yoke;

a plate fixed to a top surface of the magnet;

a voice coil disposed between an inner circumference of the yoke and outer circumferences of the magnet and the plate;

a vibration plate disposed above the plate and to which the voice coil is fixed;

a cap coupled with the yoke; and a frame coupled with the yoke and the cap, and wherein the frame comprises:

a tuning hole which is disposed to pass through from a top surface to a bottom surface of the frame and allows the first space portion and the second space portion to communicate with each other; and a tuning portion which covers the tuning hole, wherein the tuning portion comprises a first tuning portion and a second tuning portion, wherein the frame comprises a first accommodation groove formed to be concave in the top surface, and wherein the first tuning portion is disposed in the first accommodation groove and covers the tuning hole.

2. The earphone of claim 1, wherein the frame comprises a second accommodation groove formed to be concave in the bottom surface of the frame, and wherein the second tuning portion is disposed in the second accommodation groove and covers the tuning hole.

3. An earphone, in which a tuning means is provided, the earphone comprising:

a housing;
a speaker unit disposed in the housing;
a cover coupled with the housing and including a nozzle;
a first space portion disposed in front of the speaker unit; and
a second space portion disposed in the rear of the speaker unit and partitioned off from the first space portion,
wherein the speaker unit comprises:
a cylindrical yoke with an open top;
a magnet fixed to a bottom surface of an inside of the yoke;
a plate fixed to a top surface of the magnet;
a voice coil disposed between an inner circumference of the yoke and outer circumferences of the magnet and the plate;
a vibration plate disposed above the plate and to which the voice coil is fixed;
a cap coupled with the yoke; and
a frame coupled with the yoke and the cap, and
wherein the frame comprises:
a tuning hole which is disposed to pass through from a top surface to a bottom surface of the frame and allows the first space portion and the second space portion to communicate with each other; and
a tuning portion which covers the tuning hole,
wherein the tuning hole comprises a first hole and a second hole,
wherein the first hole is connected to the first space portion, and
wherein the second hole communicates with the second space portion.

4. The earphone of claim 3, wherein a sectional size of the first hole differs from a sectional size of the second hole.

5. The earphone of claim 4, wherein a length of the first hole differs from a length of the second hole.

6. An earphone, in which a tuning means is provided, the earphone comprising:
a housing;
a speaker unit disposed in the housing;
a cover coupled with the housing and including a nozzle;
a first space portion disposed in front of the speaker unit; and
a second space portion disposed in the rear of the speaker unit and partitioned off from the first space portion,
wherein the speaker unit comprises:
a cylindrical yoke with an open top;
a magnet fixed to a bottom surface of an inside of the yoke;
a plate fixed to a top surface of the magnet;
a voice coil disposed between an inner circumference of the yoke and outer circumferences of the magnet and the plate;
a vibration plate disposed above the plate and to which the voice coil is fixed;
a cap coupled with the yoke; and
a frame coupled with the yoke and the cap, and
wherein the frame comprises:
a tuning hole which is disposed to pass through from a top surface to a bottom surface of the frame and allows the first space portion and the second space portion to communicate with each other; and
a tuning portion which covers the tuning hole,
wherein the tuning portion comprises a first tuning portion and a second tuning portion,
wherein when a side facing the cover is referred to as a front and a side facing the housing is referred to as a rear on the basis of the speaker unit, the vibration plate is disposed in front of the magnet, an inlet of the tuning hole is connected to the first space portion, and an outlet of the tuning hole is connected to the second space portion, and
wherein the first tuning portion is disposed at the inlet, and the second tuning portion is disposed at the outlet.

7. The earphone of claim 6, wherein the speaker unit comprises a damper, and
wherein the damper is disposed on the top surface of the frame and comes into contact with an inner surface of the cover.

8. An earphone, in which a tuning means is provided, the earphone comprising:
a housing;
a speaker unit disposed in the housing;
a cover coupled with the housing and including a nozzle;
a first space portion disposed in front of the speaker unit; and
a second space portion disposed in the rear of the speaker unit and partitioned off from the first space portion,
wherein the speaker unit comprises:
a cylindrical yoke with an open top;
a magnet fixed to a bottom surface of an inside of the yoke;
a plate fixed to a top surface of the magnet;
a voice coil disposed between an inner circumference of the yoke and outer circumferences of the magnet and the plate;
a vibration plate disposed above the plate and to which the voice coil is fixed;
a cap coupled with the yoke; and
a frame coupled with the yoke and the cap, and
wherein the frame comprises:
a tuning hole which is disposed to pass through from a top surface to a bottom surface of the frame and allows the first space portion and the second space portion to communicate with each other; and
a tuning portion which covers the tuning hole,
wherein the tuning portion comprises a first tuning portion and a second tuning portion,
wherein when a side facing the cover is referred to as a front and a side facing the housing is referred to as a rear on the basis of the speaker unit, the vibration plate is disposed in a rear of the magnet, an inlet of the tuning hole is connected to the first space portion, and an outlet of the tuning hole is connected to the second space portion, and
wherein the first tuning portion is disposed at the inlet, and the second tuning portion is disposed at the outlet.

9. The earphone of claim 8, wherein the speaker unit comprises a damper, and
wherein the damper is disposed on the bottom surface of the frame and comes into contact with an inner surface of the housing.

* * * * *